United States Patent [19]

Torti et al.

[11] 4,094,117

[45] June 13, 1978

[54] METHOD AND TIE BAR FOR THE FORMATION OF ANCHORAGES

[75] Inventors: Giovanni Torti, Pavia; Andrea Tomiolo, Milan, both of Italy

[73] Assignee: Ing. Giovanni Rodio & C. Impresa Costruzioni Speciali S.p.A., Italy

[21] Appl. No.: 743,918

[22] Filed: Nov. 22, 1976

[30] Foreign Application Priority Data

Nov. 26, 1975 Italy ..... 29665 A/75

[51] Int. Cl.[2] ..... E21D 20/2

[52] U.S. Cl. ..... 52/698; 52/223 R; 61/45 B

[58] Field of Search ..... 61/45 B; 52/223, 225, 52/230, 223 L, 150, 309.7, 698

[56] References Cited

U.S. PATENT DOCUMENTS

| | | | |
|---|---|---|---|
| 3,332,244 | 7/1967 | McLean | 61/45 B |
| 3,425,177 | 2/1969 | Buyer | 52/230 |
| 3,899,892 | 8/1975 | Yokota | 61/45 B |
| 4,000,623 | 1/1977 | Meardi | 52/230 |

*Primary Examiner*—John E. Murtagh
*Attorney, Agent, or Firm*—McGlew and Tuttle

[57] ABSTRACT

An anchorage structure and method for positioning cables in an excavated hole, comprises a plurality of cables adapted to be subjected to a tensioning load having common ends arranged in the hole and disposed in substantially a common plane. A plate having a plurality of bores therethrough through which the ends of the cables extend is secured to the cables so that the plate is positioned substantially parallel to the plane of the common ends of the cables. A resinous mass encases the plate and the cables in an area above and on all sides of the cables, adjacent the ends thereof, leaving a remaining space in the hole around the mass and above and below the mass and concrete filled into the hole in the remaining space. Each of the cables has a coating for insulating them from the concrete and permitting an individual sliding movement of the cables.

8 Claims, 4 Drawing Figures

METHOD AND TIE BAR FOR THE FORMATION OF ANCHORAGES

The present invention is referring to the technique for the formation of anchorages in the ground, for instance for the purpose of withstanding and nullifying the thrust of ground which might be exerted on construction works, due to hydraulic or other reasons. Such anchorages are usually performed by means of tie bars, each consisting of one or a plurality of cables, rods or strands, inserted into a hole drilled in the ground, terminating into a so-called bulb of mortar or other materials, for instance resins, injected into this hole, and at last subjected to tensile stresses, for instance by discharging them on an external thrust withstanding plate, transmitting the precompression stress due to the cable tensioning, to the structure foreseen for withstanding the thrust of ground, water or other. Inside the hole drilled in the ground, the tensile stress applied to the cable or to the cables, bars and strands is transmitted to the above mentioned bulb in the lower part of the hole, branching into the ground all around the walls of the hole, constituting thereby the required anchorage. One of the main problems of such an anchorage system is the at least theoretical possibility that the cable or the cables, rods or strands, usually of steel, may with the time be subjected to such alterations which might reduce or nullify their operating capability.

Such alterations to which as it is well known metallic materials are particularly sensitive when under stress conditions, can be easily imputed to the possibility of infiltrations, particularly of water, entering in contact with the surface of the cable, bar or strand plunged into the hardened mortar.

This possibility of infiltrations or anyhow of electrical, chemical or electro-chemical attack of steel cables, bars or strands, is mainly due to the fact that the mortar mass constituting the bulb and hardened after injection, can fissure as consequence of the subsequent tensioning operations to which this cable or these cables, bars or strands are subjected. Indeed, the traction efforts on cables, bars and strands are transmitted on to the hardened mortar mainly by adherence, in correspondence of the interface between the cable and the mortar all around it.

By this way an area is determined in which the stress is transferred by the cable to the adjacent mass of mortar, and such a transfer will present maximum values on the top of the bulb, with gradual reductions toward the bottom of it. There is therefore a though theoretical risk that fissures may take place in the bulb, especially near the top portion of it, due also to the different deformation coefficient between steel and mortar when under tension, just in the area in which this tension is greater. This risk cound be unacceptable in case of permanent works of particular importance built on aggressive grounds due to chemical nature or to stray currents.

An attempt to prevent this inconveniency of the above described known systems for the formation of anchorages has been made, essentially by enclosing all cables, bars and strands into a protective element, for instance of plastic material, capable of transmitting the efforts from the internal to the external layers of mortar constituting the bulb. This system did not give anyhow the expected results, both due to the costs and complexity of its actuation, requesting two different injections of mortar, and for the fact that after the first injection has hardened it is no more possible to practically effect subsequent injections, as it is on the contrary possible when cables, bars or strands are still free into the ground, in the same way as the pipe through which the injection is performed is also free, according to a well known method which will not be described herein.

Therefore, the problem of efficiently protecting cables bars or strands is still existing, as well as that of a protective system allowing the advantages of repeated injection. To this problem must be added, in the known systems, the danger of a possible difference in the stresses transmission conditions among the various cables constituting every tie bar, with the possibility of unbalancements which can alter the required symmetrical distribution of deformations and stresses on all the cables constituting an anchorage rod.

Upon these premises, the main purpose of this invention is to ensure that the above mentioned possibilities of electrical, chemical or electro-chemical attacks on cables and alike of the tie bars may not take place, through a method for the formation of such anchorages which should be substantially simple and economical at least like the already known systems but allowing to modify the stress conditions on the bulb in such a way as to prevent any fissuration possibility with fissures reacing the metal surface of cables and strands. Basically, the invention is consisting of a method for the formation of anchorages by means of tie bars each consisting of one or a number of cables, bars or strands which are inserted through a hole in the ground, terminating into a mortar or similar bulb injected into that hole and then submitted to tensile efforts characterized by the fact that such cable or cables, bars or strands are connected to a plate in correspondence with a section of them foreseen for being incorporated into the bulb, this plate being too incorporated into the bulb or beneath it and its purpose being to transmit compression stresses to the bulb during the stage of traction of the cable or the cables, bars or strands.

Particularly, this plate is fastened at the extremity of the cable or the cables, bars or strands, practically perpendicularly to them, in such a way as to practically submit the entire bulb to compression.

Therefore, considering that transmission of the stresses from the cables, bars and strands to the bulb is no more taking place for mutual adherence but for the compression of the bulb, a first advantage is already achieved, for the elimination of the particular localized stresses which more easily can cause fissures. Furthermore, cables, bars and strands can be individually protected by means of sheaths, for instance of plastic, which prevent the access of such agents capable of causing corrosion to the surface of them, without causing obstacles to the injection of mortar both for the formation of the bulb and in the case of eventual subsequent completing injections.

On the contrary, according to the invention, such a transmission of the stress by friction between cables, bars or strands and mortar must be completely avoided, as to achieve a complete transmission of the stress from the cable or the cables to the compression bulb, for which cables can be perfectly lubricated and/or protected by means of sheaths as to allow a relatively free sliding between cables and the hardened mortar constituting the bulb.

According to another particularly advantageous characteristic of the invention, the terminal part of the cable or the cables, bars or strands, connected to the compression plate, and the plate itself, are at first conglobated into a protective closed volume of hardened resin or similar material, which can eventually be reinforced with resistant fibers and which can be deformed but not fissured under the action of the stresses arising between the compression plate and the part of bulb around this protective volume. Particularly, it is preferred to use a resin with an elasticity modulus lower to that of the mortar constituting the bulb, for instance an epoxy resin. By this way, through the use of cables, bars or strands lined with sheaths, an anchorage assembly is obtained, the metal walls of which are entirely protected against any agent capable to damage them, for which it has no more effect that the mortar may fissure or not when submitted to the tensile efforts imparted on cables and rods. Therefore, by using the method according to the invention, and an anchorage tie bar realized in such a way as to allow actuation of this method, the problem of eventual electrical, chemical or electrochemical attacks of the metal surfaces is completely solved, without changing the advantageous characteristics of easy and reiterated injections of the mortar afforded by the known systems, and realizing beside this a system of stresses on the bulb much more rational and more properly balanced as a consequence of the distribution of efforts due to the presence of the plate, than could be realized with the known systems.

The above and other particular features of the invention will be described more into detail with reference to preferred forms of realization of this invention, schematically illustrated on the attached drawing, in which.

Figure 1:
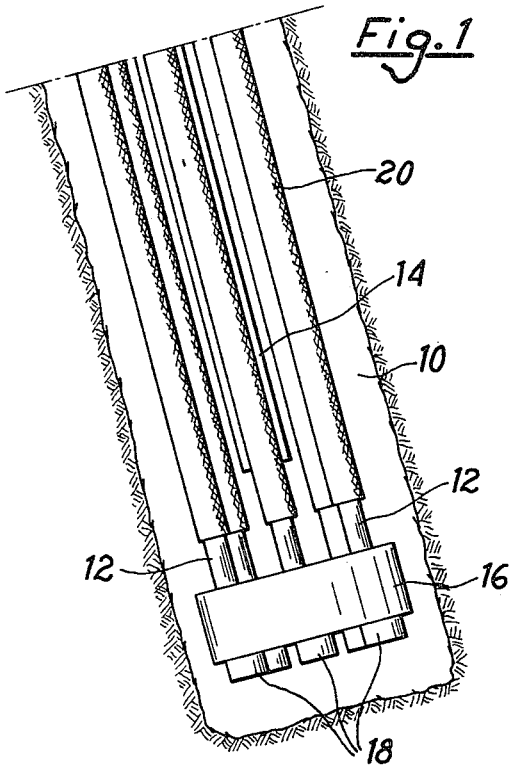
FIG. 1 is the partial view of the terminal part of a hole, into which a tie bar is inserted, shaped according to a first form of realization of the invention, before the injection of the mortar which will form the anchoring bulb.

Making reference at first to FIG. 1, an anchoring tie bar is at first inserted through a hole 10 drilled in the ground and foreseen for accomodating a bulb of mortar to be injected into the hole and the surrounding ground, under a suitable pressure, as to form an anchorage.

The tie bar is formed, in a known way, by one or several cables, bars or strands 12 of steel, placed for instance on a circumferential plane by means of suitable spacers (not shown in the drawing) all around a pipe 14 foreseen for the penetration of the injected mortar, at suitable intervals as to facilitate injection. According to a well known technique this pipe 14 will be fit with a number of "manchette" valves in different longitudinal locations as to allow localized injection of the mortar and to effect eventual further injections in those locations where it might be necessary.

For the realization of the purposes of the invention, the cables, bars or strands 12 at their end inside hole 10 are fastened to a metal plate 16 of the approximate size as hole 10 and fit with holes through which these cables, bars or strands 12 are passing, and are fastened on the opposite side of the plate 16 by means of suitable lugs 18. Furthermore these cables, bars and strands 12 are individually protected by deformable sheaths 20 as to allow a certain slip of the cables, bars or strands 12 inside the sheaths, when submitted to tension.

The anchorage is completed by injecting the mortar bulb according to the known technique, the hardening of the bulb and tensioning of the cables or strands 12. During this last operation the surface lubrication of the cables and/or the existence of sheaths 20 is allowing a certain slippage of same with respect to the mortar in such a way that all the tension efforts are transmitted to the plate 16 which by this way presses against the bulb. A transmission of the efforts for mutual adherence between cables, bars and strands, and the bulb, is therefore avoided, with all the subsequent advantages, particularly for the different operating conditions of the bulb and the prevention of fissuring of the mortar due to differences in the deformation coefficients of mortar and steel.

Figure 2:
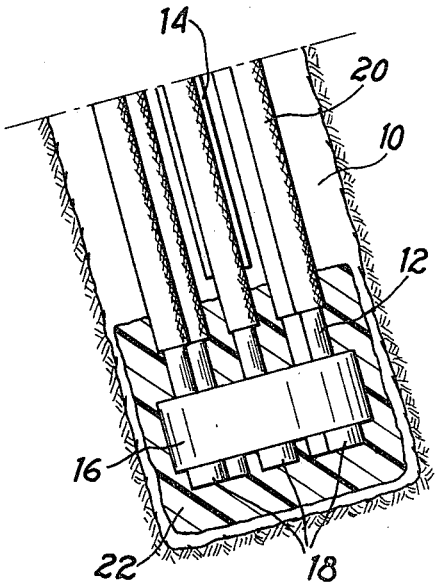
FIG. 2 is a partial view corresponding to that as illustrated in FIG. 1 and showing a second form of realization of the invention.
Figure 3:
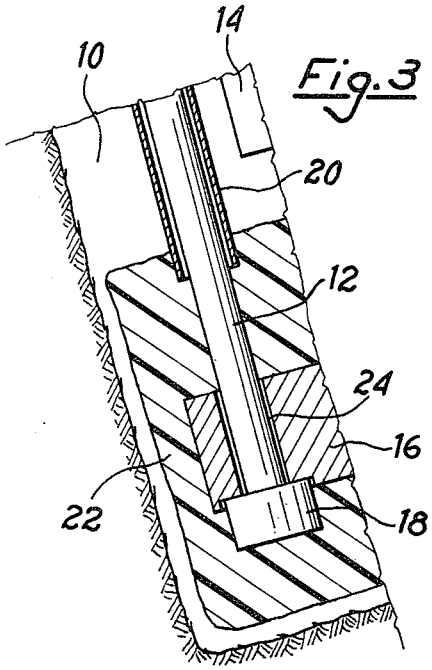
FIG. 3 is a partial and partially sectioned view, illustrating a detail of the realization form as shown in FIG. 2 on a larger scale.

As to prevent possible chemical, electrical or electrochemical attacks also in the area corresponding to plate 16 and the terminal part of the cables, bars and strands, the realization form as illustrated in FIGS. 2 and 3 has been foreseen; according to this form, the terminal part of the cables and the plate 16 and conglobated in a closed protective volume 22 of a material capable to warp under the stresses originated by the tensioning of the cables after the injection of the bulb, but anyhow such as not to be fissured. For instance, this material could consist of a resin having an elasticity modulus inferior to that of mortar, preferably an epoxy resin or anyhow a resin capable of supporting plastic deformation without fissuring. Such a protective volume can be constituted prior to introduce the tie bar into hole 10 through the hardening of a resin, for instance a two-components resin, inside a mould. Such a resin can be armoured with suitable fibers. By this way, after injection and hardening of the mortar and after tensioning of the cables, bars of strands 12, the bulb is compressed by the above mentioned protective block 22 which, as it can be seen from FIGS. 2 and 3, is enclosing also the extremities of the protective sheaths 20. By this way all the metal components of the tie bars are completely protected by means of linings granting electrical and chemical insulation also in case of eventual fissuration of the mortar.

FIG. 3 is illustrating more into detail the realization form of FIG. 2, in which openings 24 in plate 16 can be noticed, through which cables, bars or strands are passing, and it can also be noted that the injection pipe 14 is discontinued before reaching the protective enclosure 22 to eventually allow injection of the mortar also from the extremity of this pipe 14.

Figure 4:
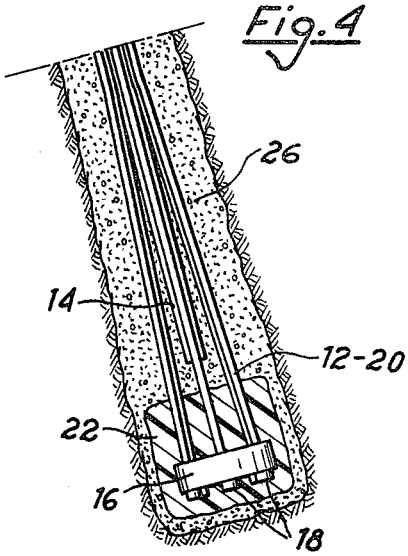
FIG. 4 is a schematic view, on reduced scale, showing the conditions of the complete anchorage constructed in accordance with the realization forms illustrated in FIGS. 2 and 3.

FIG. 4 is illustrating the final assembly, after the injection of bulb 26 filling hole 10 with eventual branching inside its walls, when allowed by the nature of ground and the pressure of injection.

Eventual so-called "radiation" armatures can be foreseen, of the known type, to absorb the concentrated loads transmitted by the plate included in the bulb.

According to the known techniques such armatures can consist of a steel spiral around the cables, bars or strands just before the above mentioned plate and eventually also partially enclosed into the protective deformating volume.

To be noted that although some preferred realization forms have been described, same may be subjected to a number of amendments and modifications at option of the involved operators without being excluded from the ambit of the invention.

We claim:

1. A method of forming an anchorage for a plurality of cables subject to tensioning, comprising excavating the ground to form a hole, arranging a plate in a plane substantially perpendicular to the axes of said cables adjacent the common ends thereof and securing the plate to the cables, coating the length of each of said cables spaced from the ends engaged with the plate with an insulating sheath having a low friction characteristic so that cables may slide, enclosing the plate and the uncoated portions of the cables in the vicinity of the plate and the ends of the cables with a large resinous mass of a size smaller than the width and depth of the hole, inserting the cables with the resinous mass into the hole, leaving a remaining space in the hole around the sides, top and bottom of the mass, and injecting mortar into the remaining space so as to form a mortar bulb around, above and below the resinous mass in said cables and permitting it to harden.

2. A method of claim 1, wherein the modulus of elasticity of the resinous mass is lower than that of the hardened concrete.

3. A method according to claim 1, wherein the coatings of the cables comprises an epoxy resin.

4. A method according to claim 1, using a plate which has a plurality of bores therethrough for the passage of the cables with recesses around the bores at the lower ends of the plates and including applying fastening lugs to the ends of the cables which pass through the bores and engaging the fastening lugs in the recesses.

5. A method according to claim 1, wherein the concrete is injected under pressure at a location above the resinous mass.

6. An anchorage structure for positioning cables in an excavated hole, comprising a plurality of cables adapted to be subjected to a tensioning load having common ends arranged in the hole and disposed in substantially a common plane, a plate having a plurality of bores therethrough through which the ends of the cables extend, means securing said cables to said plate so that said plate is positioned in substantially parallel to the plane of the common ends of said cables, a resinous mass encasing said plate and said cables in an area above and on all sides of said cables adjacent the ends thereof leaving a remaining space in the hole around said mass and above and below said mass, and a concrete filled in the hole in the remaining space, said plate comprising a polymeric mass having an elasticity modulus less than that of concrete and subject to warping but not fissuring when under stress.

7. An anchorage structure for positioning cables in an excavated hole, comprising a plurality of cables adapted to be subjected to a tensioning load having common ends arranged in the hole and disposed in substantially a common plane, a plate having a plurality of bores therethrough through which the ends of the cables extend, means securing said cables to said plate so that said plate is positioned in substantially parallel to the plane of the common ends of said cables, a resinous mass encasing said plate and said cables in an area above and on all sides of said cables adjacent the ends thereof leaving a remaining space in the hole around said mass and above and below said mass, and a concrete filled in the hole in the remaining space, a coating on each of said cables insulating said cables from said concrete and permitting individual sliding movement of said cables.

8. An anchorage according to claim 7, including a concrete injection pipe having a bore through which one of said cables extends for injecting water in the remaining space.

* * * * *